US008051843B2

(12) United States Patent
Matsudaira

(10) Patent No.: US 8,051,843 B2
(45) Date of Patent: Nov. 8, 2011

(54) STRUCTURE FOR INTRODUCING GAS INTO INTAKE AIR

(75) Inventor: Junichi Matsudaira, Nissin (JP)

(73) Assignee: Toyota Jidosha Kabushiki Kaisha, Aichi-Ken (JP)

( * ) Notice: Subject to any disclaimer, the term of this patent is extended or adjusted under 35 U.S.C. 154(b) by 396 days.

(21) Appl. No.: 12/349,071

(22) Filed: Jan. 6, 2009

(65) Prior Publication Data

US 2009/0173306 A1 Jul. 9, 2009

(30) Foreign Application Priority Data

Jan. 8, 2008 (JP) ..... 2008-001331

(51) Int. Cl.
*F02M 25/07* (2006.01)
*F02B 47/08* (2006.01)

(52) U.S. Cl. ..... 123/568.17; 123/568.11

(58) Field of Classification Search ..... 123/568.11–568.13, 568.15, 568.17, 123/568.18, 184.31, 184.34, 184.45, 572, 123/520, 698, 41.31; 60/605.2
See application file for complete search history.

(56) References Cited

U.S. PATENT DOCUMENTS

| | | | | |
|---|---|---|---|---|
| 3,513,816 | A * | 5/1970 | Daigh | 123/568.17 |
| 4,615,324 | A * | 10/1986 | Choushi et al. | 123/568.17 |
| 5,490,488 | A * | 2/1996 | Aversa et al. | 123/568.12 |
| 5,960,759 | A * | 10/1999 | Ohsuga et al. | 123/184.31 |
| 6,691,686 | B2 * | 2/2004 | Klas et al. | 123/568.17 |

FOREIGN PATENT DOCUMENTS

| | | | |
|---|---|---|---|
| EP | 0 223 378 | A2 | 5/1987 |
| JP | 61-101612 | U | 6/1986 |
| JP | 64-73114 | A | 3/1989 |
| JP | 02-40021 | A | 2/1990 |
| JP | 02-074561 | U | 6/1990 |
| JP | 10-122071 | A | 5/1998 |
| JP | 2005-133644 | A | 5/2005 |
| JP | 2005-163684 | A | 6/2005 |

OTHER PUBLICATIONS

German Office Action for corresponding German Patent Application No. 10 2009 000 035.6 issued on Jul. 28, 2010, 6 pages.
Japanese Office Action for corresponding Japanese Patent Application No. JP 2008-001331 drafted Nov. 26, 2009 and issued on Dec. 1, 2009, 6 pages.

* cited by examiner

*Primary Examiner* — Willis Wolfe, Jr.
(74) *Attorney, Agent, or Firm* — Sughrue Mion, PLLC

(57) ABSTRACT

Exhaust gas inlets for introducing exhaust gas from an EGR pipe, on the right bank side, and exhaust gas inlets for introducing exhaust gas from the EGR pipe, on the left bank side, are both formed in low-pressure regions. The exhaust gas inlets are formed at positions where the pressure of the intake air flowing through branch pipes on the right bank side and the pressure of the intake air flowing through branch pipes on the left bank side are both low and substantially equal. Accordingly, exhaust gas is introduced evenly into cylinders in the right and left banks. These inlets are not formed at positions in a common intake passage from which branch paths branch off, that is, positions upstream of a surge tank. Accordingly, the response to introduction of exhaust gas is not deteriorated but is maintained.

15 Claims, 5 Drawing Sheets

STRUCTURE FOR INTRODUCING GAS INTO INTAKE AIR

INCORPORATION BY REFERENCE

The disclosure of Japanese Patent Application No. 2008-001331 filed on Jan. 8, 2008 including the specification, drawings and abstract is incorporated herein by reference in its entirety.

BACKGROUND OF THE INVENTION

1. Field of the Invention

The invention relates to a structure for introducing gas into intake air in an internal combustion engine which includes a plurality of banks and in which the intake air is distributed to cylinders through individual intake passages that branch off from a common intake passage.

2. Description of the Related Art

Examples of existing devices that introduce gas into air taken in an internal combustion engine include an exhaust gas recirculation (hereinafter, referred to as "EGR" where appropriate) device that recirculates exhaust gas discharged from combustion chambers of the internal combustion engine back to the combustion chambers through a recirculation passage (refer to, for example, Japanese Patent Application Publication No. 2005-163684 (JP-A-2005-163684), Japanese Utility Model Application Publication No. 02-74561 (JP-U-02-74561), Japanese Patent Application Publication No. 10-122071 (JP-A-10-122071), and Japanese Patent Application Publication No. 2005-133644 (JP-A-2005-133644).

According to JP-A-2005-163684, an opening through which exhaust gas is introduced into an intake passage is formed at a position in each intake passage, at which the pressure is lower than the pressure of the exhaust gas. According to this technology, a sufficient amount of exhaust gas is introduced into each combustion chamber of an internal combustion engine. According to each of JP-U-02-74561 and JP-A-10-122071, in a V-internal combustion engine, a single EGR passage is formed between an intake passage group for one of banks and an intake passage group for the other bank and openings of introduction passages, which provide communication between the EGR passage and the intake passages for respective cylinders in the banks, are formed. With this structure, exhaust gas is supplied to the cylinders individually.

According to JP-A-2005-133644, exhaust gas is introduced into intake air, at a position in a common intake passage that is shared by all cylinders.

The internal combustion engine described in JP-A-2005-163684 includes a single bank. If the technology described in JP-A-2005-163684 is applied to an internal combustion engine that includes a plurality of banks, it may be possible to introduce a sufficient amount of exhaust gas into cylinders in each bank. However, whether it is possible to introduce the exhaust gas evenly into the cylinders in all the banks is not known from JP-A-2005-163684. Therefore, applying the technology described in JP-A-2005-163684 to an internal combustion engine that includes a plurality of banks without any modification may not be very effective. Even if this technology, in which the opening is formed at the position in each intake passage at which the pressure is lower than the pressure of the exhaust gas, is applied to such an internal combustion engine, whether it is possible to introduce the exhaust gas evenly into the cylinders in all the banks is not known.

According to JP-U-02-74561 and JP-A-10-122071, the single EGR passage is communicated with the intake passages in the respective groups on both sides of the EGR passage; and the EGR passage is connected to a wall face of each intake passage at a portion closest to the EGR passage. With this structure, whether the pressure distribution within the intake passage is uniform between the intake passage groups depends on the location of a common intake passage from which the intake passages in the groups branch off. Therefore, if the EGR passage is connected to the wall face of each intake passage at the portion closest to the EGR passage as described in JP-U-02-74561 and JP-A-10-122071, there is a high possibility that the exhaust gas will not be introduced into the cylinders evenly. Therefore, the amount of exhaust gas that is introduced into each cylinder is not brought substantially equal to the theoretical introduction amount and needs to be restricted, because the possibility of unstable combustion is taken into account. As a result, it is not possible to enhance the fuel efficiency to a sufficient degree.

According to JP-A-2005-133644, the exhaust gas is introduced into the common intake passage from which individual intake passages branch off. Therefore, the exhaust gas may be easily introduced into all the cylinders evenly. However, the exhaust gas is introduced into the common intake passage that is upstream of the individual intake passage groups. Therefore, an intake air path that extends from the position at which the exhaust gas is actually introduced into the intake passage to each combustion chamber is long, which deteriorates the response to introduction of the exhaust gas. These problems may occur also when another type of gas, for example, blowby gas or purge fuel gas from a canister, is introduced into the intake air.

SUMMARY OF THE INVENTION

The invention makes it possible to introduce gas evenly into cylinders with response to introduction of the gas maintained, even in an internal combustion engine that includes a plurality of banks.

An aspect of the invention relates to a structure for introducing gas into intake air in an internal combustion engine which includes a plurality of banks and in which the intake air is distributed to cylinders through individual intake passages that branch off from a common intake passage. According to the aspect of the invention, gas inlets are formed in wall faces of the individual intake passages at positions where pressures of the intake airs flowing through the individual intake passages that lead to the cylinders in the plurality of banks are substantially equal to each other.

Because the gas inlets are formed in the wall faces of the individual intake passages at the positions where the pressures of the intake airs flowing through the individual intake passages that lead to the cylinders in the plurality of banks are substantially equal to each other, it is possible to introduce the gas evenly into the cylinders. The gas inlets are formed not in a wall face of the common intake passage from which the individual intake passages branch off, but in the wall faces of the individual intake passages. Therefore, the response to introduction of the gas is not deteriorated but is maintained.

In the structure described above, the number of the banks of the internal combustion engine may be two, and a branch portion at which the individual intake passages branch off from the common intake passage is located on the side of one of the two banks.

When the branch portion is located on the side of one of the banks, if the gas inlets are formed in the wall faces at portions closest to a pipe, from which the gas is introduced, there is a high possibility that the gas is not evenly introduced into the cylinders. In contrast, in the structure described above, the gas inlets are formed at the positions where the pressures of the intake airs flowing through the individual intake passages are substantially equal to each other. Therefore, the gas is introduced evenly into the cylinders with the response to introduction of the gas maintained.

In the structure described above, the common intake passage may include a surge tank that is formed at the branch portion, and the individual intake passages may branch off from the surge tank.

If the gas inlets are formed in the wall faces at the portions closest to the pipe, from which the gas is introduced, when the surge tank is formed at the branch portion, there is a high possibility that the gas is not evenly introduced into the cylinders. However, with the structure described above, the gas is introduced evenly into the cylinders with the response to introduction of the gas maintained.

In the structure described above, the gas inlets may be formed in the wall faces at portions on the same side in the same direction among directions perpendicular to the direction in which the individual intake passages for each bank are aligned.

As described above, the gas inlets are formed in the wall faces at the portions on the same side in the same direction among the directions perpendicular to the direction in which the individual intake passages for each bank are aligned, instead of being formed in the wall faces at the portions closest to the pipe, from which the gas is introduced. With such simple structure, it is possible to form the gas inlets at the positions where the pressures of the intake airs flowing through the individual intake passages are substantially equal to each other. Accordingly, the gas is introduced evenly into the cylinders with the response to introduction of the gas maintained.

In the structure described above, the side on which the gas inlets are formed may be the side on which the branch portion is located. The individual passages extend from the branch portion and curve toward the respective cylinders in the banks. In the structure described above, the portions of the wall faces on the side on which the branch portion is located correspond to the inner curve portions of the curved portions of the individual passages for both the banks. Therefore, it is possible to form the gas inlets in the wall faces at the positions where the pressures of the intake airs flowing through the individual passages are substantially equal to each other. Thus, the gas is introduced evenly into the cylinders with the response to introduction of the gas maintained. In addition, the pressures of the intake airs flowing through the individual passages are all low and substantially equal to each other at the inner curve portions of the curved portions. As a result, the amount of gas introduced per unit time increases, which makes it possible to introduce a large amount of gas with a higher response.

In the structure described above, the side on which the gas inlets are formed may be the side opposite to the side on which the branch portion is located.

The individual passages extend from the branch portion and curve toward the respective cylinders in the banks. In the structure described above, the portions of the wall faces on the side opposite to the side on which the branch portion is located correspond to the outer curve portions of the curved portions of the individual passages for both the banks. Therefore, it is possible to form the gas inlets in the wall faces at the positions where the pressures of the intake airs flowing through the individual passages are all high and substantially equal to each other. Because the gas inlets are formed in the wall faces at the positions where the pressures of the intake airs flowing through the individual passages are substantially equal to each other, the gas is introduced evenly into the cylinders with the response to introduction of gas maintained.

In the structure described above, the portions of the wall faces of the individual intake passages at which the gas inlets are formed may correspond to inner curve portions of curved portions of the individual intake passages that extend from the branch portion.

Because the portions of the wall faces of the individual intake passages at which the gas inlets are formed correspond to the inner curve portions of the curved portions of the individual intake passages, the gas is introduced evenly into the cylinders with the response to the introduction of the gas maintained. In addition, the pressures of the intake airs flowing through the intake passages are all low and substantially equal to each other at the inner curve portions of the curved portions of the individual intake passages. As a result, the amount of gas introduced per unit time increases, which makes it possible to introduce a large amount of gas with a higher response.

In the structure described above, the portions of the wall faces of the individual intake passages at which the gas inlets are formed may correspond to outer curve portions of curved portions of the individual intake passages that extend from the branch portion.

Because the portions of the wall faces of the individual intake passages at which the gas inlets are formed correspond to the outer curve portions of the curved portions of the individual intake passages, the pressures of the intake airs flowing through the intake passages are all high and substantially equal to each other at the gas inlets. As a result, the gas is introduced evenly into the cylinders with the response to introduction of the gas maintained.

In the structure described above, the gas may be exhaust gas. The structure may be applied to EGR, and the exhaust gas is introduced evenly into the cylinders with the response to introduction of the exhaust gas maintained.

In the structure described above, the gas may be blowby gas or purge fuel gas from a canister.

The structure may be applied to a blowby gas process or gas purging, and the gas is introduced evenly into the cylinders with the response to introduction of the gas maintained.

BRIEF DESCRIPTION OF THE DRAWINGS

The foregoing and further features and advantages of the invention will become apparent from the following description of example embodiments with reference to the accompanying drawings, wherein the same or corresponding portions will be denoted by the same reference numerals and wherein.

DETAILED DESCRIPTION OF THE EMBODIMENTS

Figure 1:
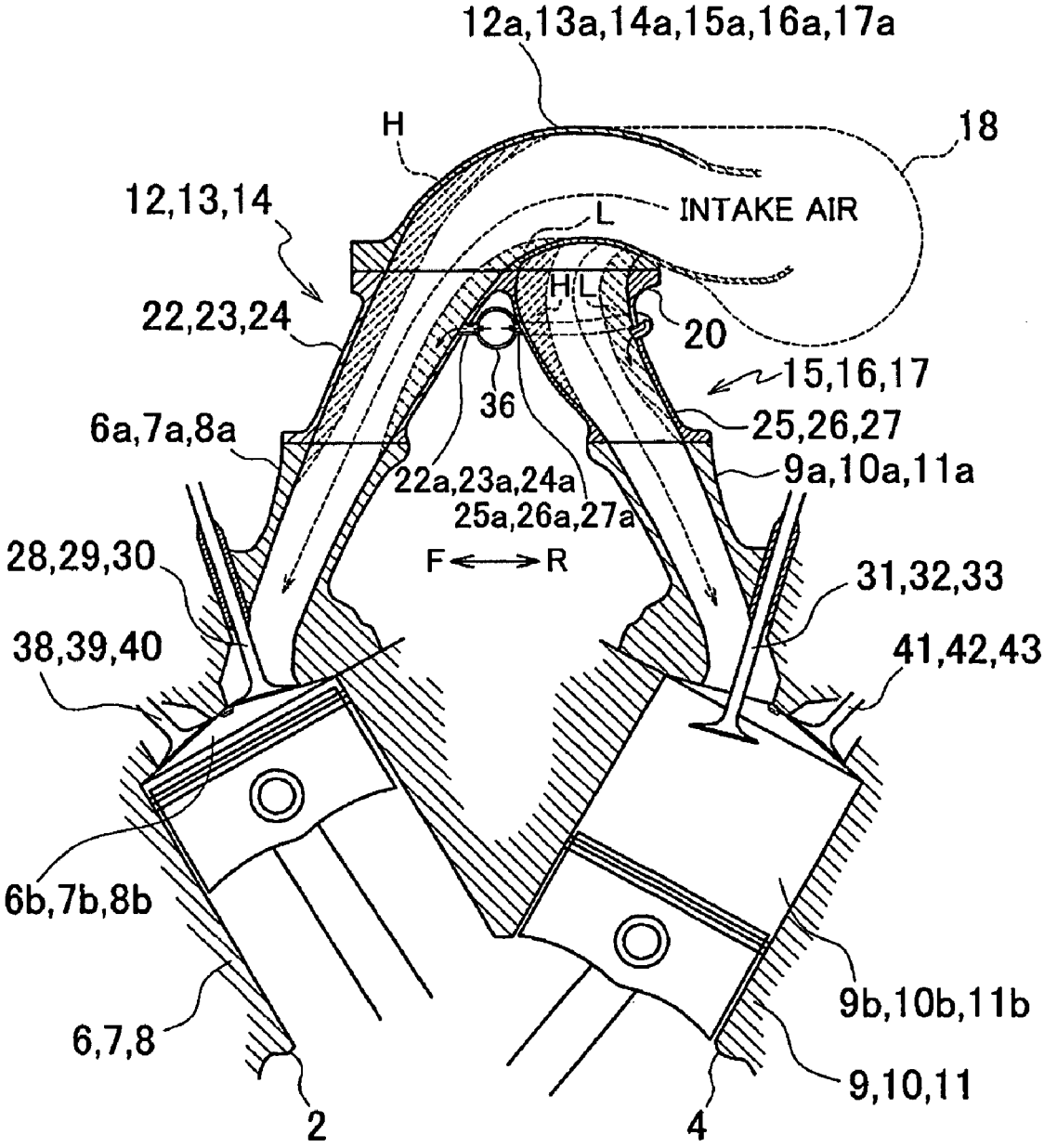
FIG. 1 is a longitudinal cross-sectional view schematically showing the structure of a mechanism that introduces gas into intake air in a V-6 internal combustion engine according to a first embodiment of the invention.
Figure 2:
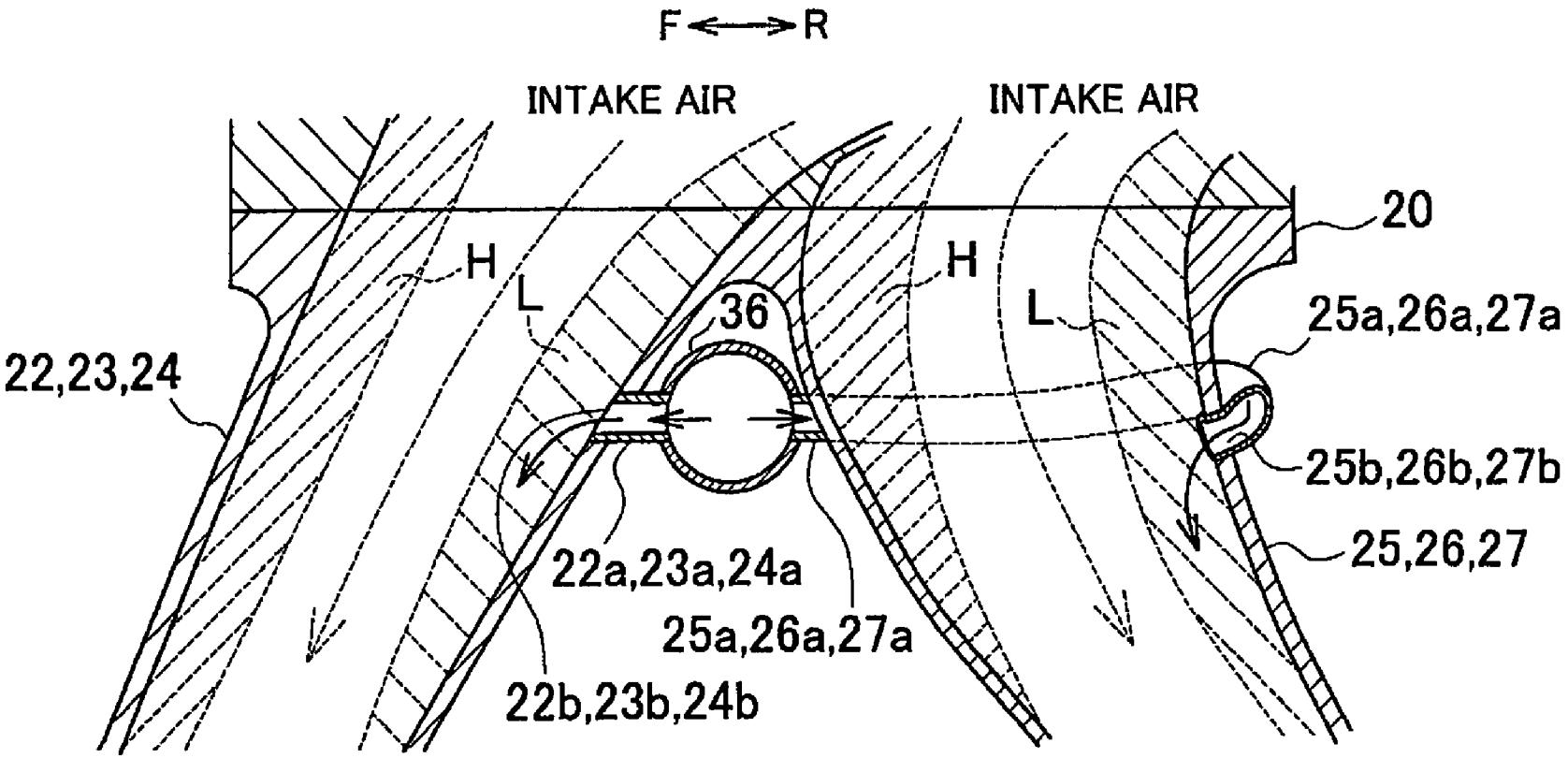
FIG. 2 is an enlarged view showing a main portion of the mechanism in FIG. 1.

Hereafter, a first embodiment of the invention will be described. FIG. 1 is a longitudinal cross-sectional view schematically showing the structure of a mechanism that introduces gas into intake air in a V-6 internal combustion engine according to the first embodiment of the invention. FIG. 2 is an enlarged view showing a main portion of the mechanism shown in FIG. 1. In the first embodiment of the invention, the mechanism that introduces gas into the intake air is used to perform EGR.

The internal combustion engine is mounted in a FF (front-engine front-drive) vehicle. In an example in FIG. 1, the internal combustion engine includes a right bank 2 and a left bank 4. The right bank 2 is anterior to the left bank 4 in the direction indicated by an arrow F, and the left bank 4 is posterior to the right bank 2 in the direction indicated by an arrow R. FIG. 1 is a longitudinal cross-sectional view showing the structure of each of cylinders 6, 7 and 8 in the right bank 2, the structure of each of cylinders 9, 10 and 11 in the left bank 4, the structure of each of intake passages 12, 13 and 14 through which the intake air is supplied to the cylinders 6, 7 and 8, respectively, and the structure of each of intake passages 15, 16 and 17 through which the intake air is supplied to the cylinders 9, 10 and 11, respectively.

The intake passages 12, 13, 14, 15, 16 and 17, through which the intake air is supplied to the cylinders 6, 7, 8, 9, 10 and 11, include branch paths 12*a*, 13*a*, 14*a*) 15*a*, 16*a* and 17*a* that are formed integrally with a surge tank 18, which is a part of a common intake passage, and that branch off from the common intake passage so as to correspond to the cylinders 6, 7, 8, 9, 10 and 11, an intake manifold 20 that is connected to these branch paths 12*a*, 13*a*, 14*a*, 15*a*, 16*a* and 17*a*, and intake ports 6*a*, 7*a*, 8*a*, 9*a*, 10*a* and 11*a* that are connected to the intake manifold 20, respectively. The branch paths 12*a* to 17*a*, the intake manifold 20, and the intake ports 6*a* to 11*a* may be regarded as individual intake passages.

The intake air is taken from the outside of the internal combustion engine into the surge tank 18 through, for example, a filter, and distributed to branch pipes 22, 23, 24, 25, 26 and 27 of the intake manifold 20 through the branch paths 12*a*, 13*a*, 14*a*, 15*a*, 16*a* and 17*a*, respectively. The thus distributed intake air is supplied from the intake ports 6*a*, 7*a* and 8*a* to combustion chambers 6*b*, 7*b* and 8*b* of the three cylinders 6, 7 and 8 in the right bank 2 through intake valves 28, 29 and 30, respectively, and is supplied from the intake ports 9*a*, 10*a* and 11*a* to combustion chambers 9*b*, 10*b* and 11*b* of the three cylinders 9, 10 and 11 in the left bank 4 through intake valves 31, 32 and 33, respectively.

An EGR pipe 36 is arranged between the three branch pipes 22 to 24 of the intake manifold 20, which are on the right bank 2 side, and the three branch pipes 25 to 27 of the intake manifold 20, which are on the left banks 4 side. The EGR pipe 36 is provided at a position considerably close to the branch pipes 22 to 27. The EGR pipe 36 extends in the direction in which the intake passages 12 to 14 are aligned and the intake passages 15 to 17 are aligned. The exhaust gas that is discharged from the combustion chambers 6*b*, 7*b*, 8*b*, 9*b*, 10*b* and 11*b* through exhaust valves 38, 39, 40, 41, 42 and 43, respectively, is supplied to the EGR pipe 36 through an EGR valve of which the opening amount is adjusted based on the operating state of the internal combustion engine. The exhaust gas supplied to the EGR pipe 36 is used as the EGR gas that is mixed with the intake air.

The EGR pipe 36 is connected to the six branch pipes 22, 23, 24, 25, 26 and 27 via gas introduction passages 22*a*, 23*a*, 24*a*, 25*a*, 26*a* and 27*a* that are formed for the branch pipes 22, 23, 24, 25, 26 and 27, respectively, and communication is thus provided between the EGR pipe 36 and the six branch pipes 22 to 27. At inlets 22*b*, 23*b* and 24*b* that are formed in wall faces of the branch pipes 22, 23 and 24 at portions closest to the EGR pipe 36, the gas introduction passages 22*a*, 23*a* and 24*a* for the cylinders 6, 7 and 8 in the right bank 2 are connected to the branch pipes 22, 23 and 24, respectively. The portions of the wall faces of the branch pipes 22 to 24, which are closest to the EGO pipe 36, are rear portions of the wall faces of the branch pipes 22 to 24.

The gas introduction passages 25*a*, 26*a* and 27*a* for the cylinders 9, 10 and 11 in the left bank 4 first extend to positions immediately behind the branch pipes 25, 26 and 27, and then connected to the branch pipes 25, 26 and 27 at inlets 25*b*, 26*b* and 27*b* that are formed in rear portions of wall faces of the branch pipes 25, 26 and 27, respectively.

That is, the gas introduction passages 22*a*, 23*a* and 24*a* for the cylinders 6, 7 and 8 in the right bank 2 are connected to the rear portions of the wall faces of the branch pipes 22, 23 and 24, respectively, and, similarly, the gas introduction passages 25*a*, 26*a* and 27*a* for the cylinders 9, 10 and 11 in the left bank 4 are connected to the rear portions of the wall faces of the branch pipes 25, 26 and 27, respectively. Then, the exhaust gas is introduced into the branch pipes 22, 23 and 24 through the inlets 22*b*, 23*b* and 24*b* that are formed in the rear portions of the wall faces of the branch pipes 22, 23 and 24, respectively. Similarly, the exhaust gas is introduced into the branch pipes 25, 26 and 27 through the inlets 25*b*, 26*b* and 27*b* that are formed in the rear portions of the wall faces of the branch pipes 25, 26 and 27, respectively.

Due to limitation of space in an engine room, the surge tank 18, which is a part of the common intake passage, is located on the left bank 4 side, that is, on the rear bank side, on which available space is larger. Accordingly, the intake passages 12 to 14 through which the intake air is supplied to the cylinders 6 to 8 in the right bank 2, respectively, and the intake passages 15 to 17 through which the intake air is supplied to the cylinders 9 to 11 in the left bank 4, respectively, are not bilaterally symmetric when viewed in the direction in which the cylinders 6 to 8 are aligned and the cylinders 9 to 11 are aligned. The intake passages 12 to 14 and the intake passages 15 to 17 extend from the surge tank 18 in such a manner that these intake passages 12 to 17 first extend forward from the surge tank 18 and then curve downward. Therefore, a high-pressure region H is formed in a front-side portion in each of the intake passages 12 to 14 on the right bank 2 side and in a front-side portion in each of the intake passages 15 to 17 on the left bank 4 side. The high-pressure region H is formed, because a large amount of intake air hits the front portion of the wall face of each of the intake passages 12 to 14 and then flows into the high-pressure region H while the intake air is flows through a curved portion. At the same time, a low-pressure region L is formed in a rear-side portion in each of the intake passages 12 to 14 on the right bank 2 side and a rear-side portion in each of the intake passages 15 to 17 on the left bank 4 side. The low-pressure region L is formed, because only a small amount of intake air flows into the low-pressure region L and the intake air in the low-pressure region L is attracted toward the high-pressure region H while the intake air flows through the curved portion.

Therefore, the inlets 22*b* to 24*b* for the cylinders 6 to 8 in the right bank 2 and the inlets 25*b* to 27*b* for the cylinders 9 to 11 in the left bank 4 are both formed in the low-pressure regions L in which the pressure of the intake air is low. Therefore, the exhaust gas is introduced from the EGR pipe 36 into both the cylinders 6 to 8 in the right bank 2 and the cylinders 9 to 11 in the left bank 4 through the low-pressure regions L.

According to the first embodiment of the invention described above, the following effects are obtained. 1) The inlets 22*b* to 24*b* through which the exhaust gas is introduced from the EGR pipe 36 into the intake passages 12 to 14 for the cylinders 6 to 8 in the right bank 2, respectively, are within the low-pressure regions L. Similarly, the inlets 25*b* to 27*b* through which the exhaust gas is introduced from the EGR pipe 36 into the intake passages 15 to 17 for the cylinders 9 to 11 in the left bank 4, respectively, are within the low-pressure regions L. That is, the exhaust gas inlets 22*b* to 27*b* are formed at positions where the pressure of the intake air flowing through the branch pipes 22 to 24 for the cylinders 6 to 8 in the right bank 2, respectively, and the pressure of the intake air flowing through the branch pipes 25 to 27 for the cylinders 9 to 11 in the left bank 4, respectively, are both low and therefore substantially equal to each other. Accordingly, the amount of exhaust gas that is introduced into each of the cylinders 6 to 8 in the right bank 2 and the amount of exhaust gas that is introduced into each of the cylinders 9 to 11 in the left bank 4 are substantially equal to each other. These inlets 22*b* to 27*b* are not formed at positions in the common intake passage from which the branch paths 12*a* to 17*a* branch off, that is, these inlets 22*b* to 27*b* are not formed at positions upstream of the surge tank 18. Accordingly, the response to introduction of the exhaust gas is not deteriorated but is maintained.

2) The surge tank 18 is located on the left bank 4 side. Therefore, if the gas introduction passages 22*a* to 27*a*, through which the exhaust gas is introduced from the EGR pipe 36, are connected to the wall faces of the branch pipes 22 to 27 at portions closest to the EGR pipe 36, the location of the exhaust gas inlet varies between the right bank 2 side and the left bank 4 side. On the right bank 2 side, the exhaust gas inlets are formed in the wall faces of the branch pipes 22 to 24 at the portions in the low-pressure regions L. However, on the left bank 4 side, the exhaust gas inlets are formed in the wall faces of the branch pipes 25 to 27 at the portions in the high-pressure regions H. Therefore, the exhaust gas inlets are not formed at positions where the pressure of the intake air is substantially equal to each other. As a result, it is not possible to introduce the exhaust gas evenly into the cylinders 6 to 11.

In contrast, according to the first embodiment of the invention, the exhaust gas inlets 22*b* to 27*b* are formed in the wall faces of the branch pipes 22 to 27 at portions that are on the side on which a branch portion of the surge tank 18, at which the branch paths 12*a* to 17*a* branch off from the surge tank 18, is located. That is, the portions of the wall faces of the branch pipes 22 to 24, at which the exhaust gas inlets 22*b* to 24*b* are formed, respectively, and the portions of the wall faces of the branch pipes 25 to 27, at which the exhaust gas inlets 25*b* to 27*b* are formed, respectively, are on the same side in the same direction among the directions perpendicular to the direction in which the intake passages 12 to 14 are aligned and the intake passages 15 to 17 are aligned (direction perpendicular to the sheets on which FIGS. 1 and 2 are drawn). In other words, the exhaust gas inlets 22*b* to 27*b* are formed in the wall faces of the branch pipes 22 to 27 at the portions, which correspond to inner curve portions of curved portions of the intake passages 12 to 17 that extend from the branch portion of the surge tank 18, respectively.

With this simple structure, it is possible to introduce the exhaust gas evenly into the cylinders 6 to 11 with the response to introduction of the exhaust gas maintained. In addition, because the pressure is low and therefore the low-pressure regions L are formed at the inner curve portions of the curved portions of the intake passages 12 to 17, the amount of exhaust gas introduced into the intake air per unit time increases and a large amount of exhaust gas is introduced into the intake air with a higher response.

Figure 3:
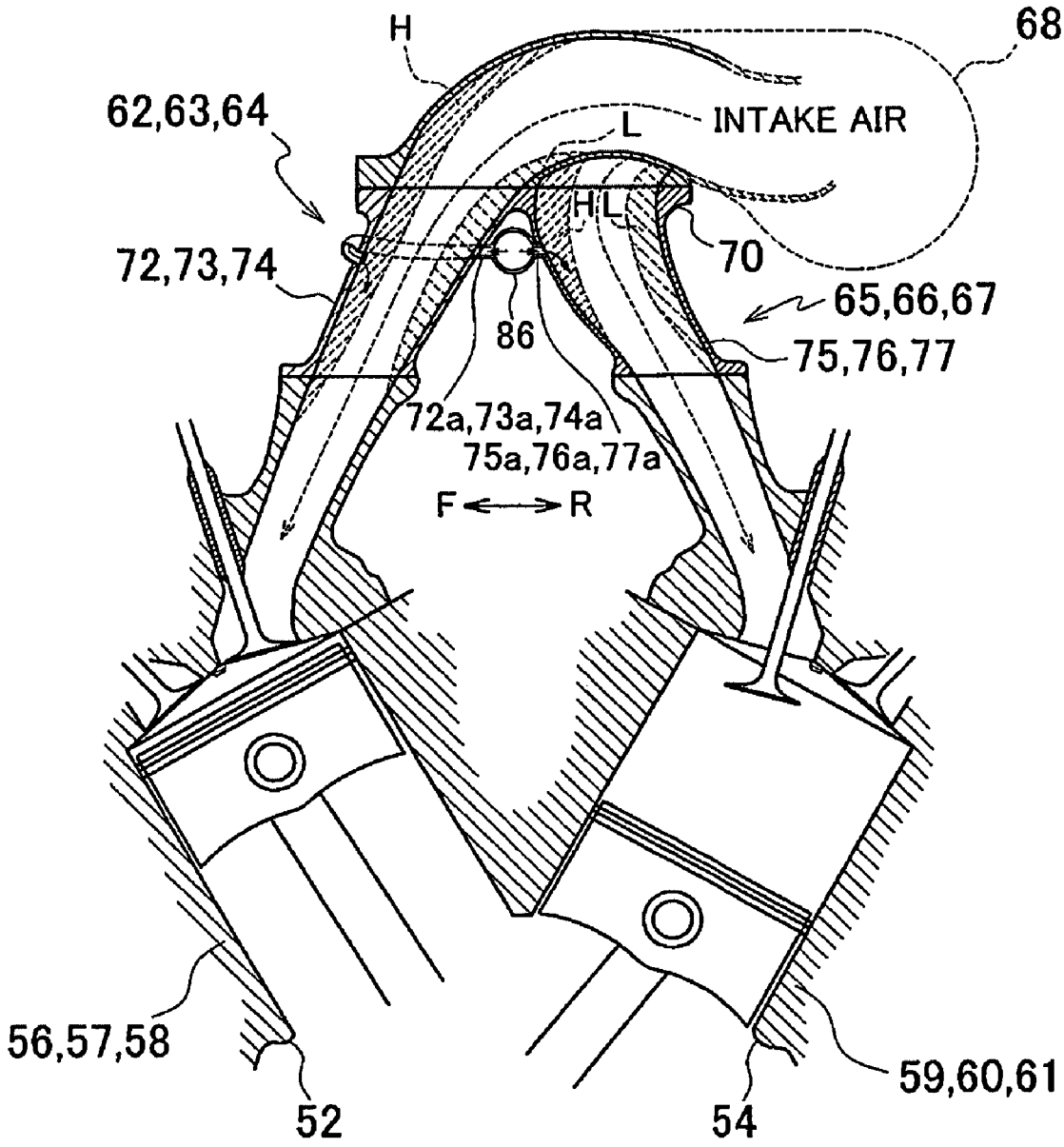
FIG. 3 is a longitudinal cross-sectional view schematically showing the structure of a mechanism that introduces gas into intake air in a V-6 internal combustion engine according to a second embodiment of the invention.
Figure 4:
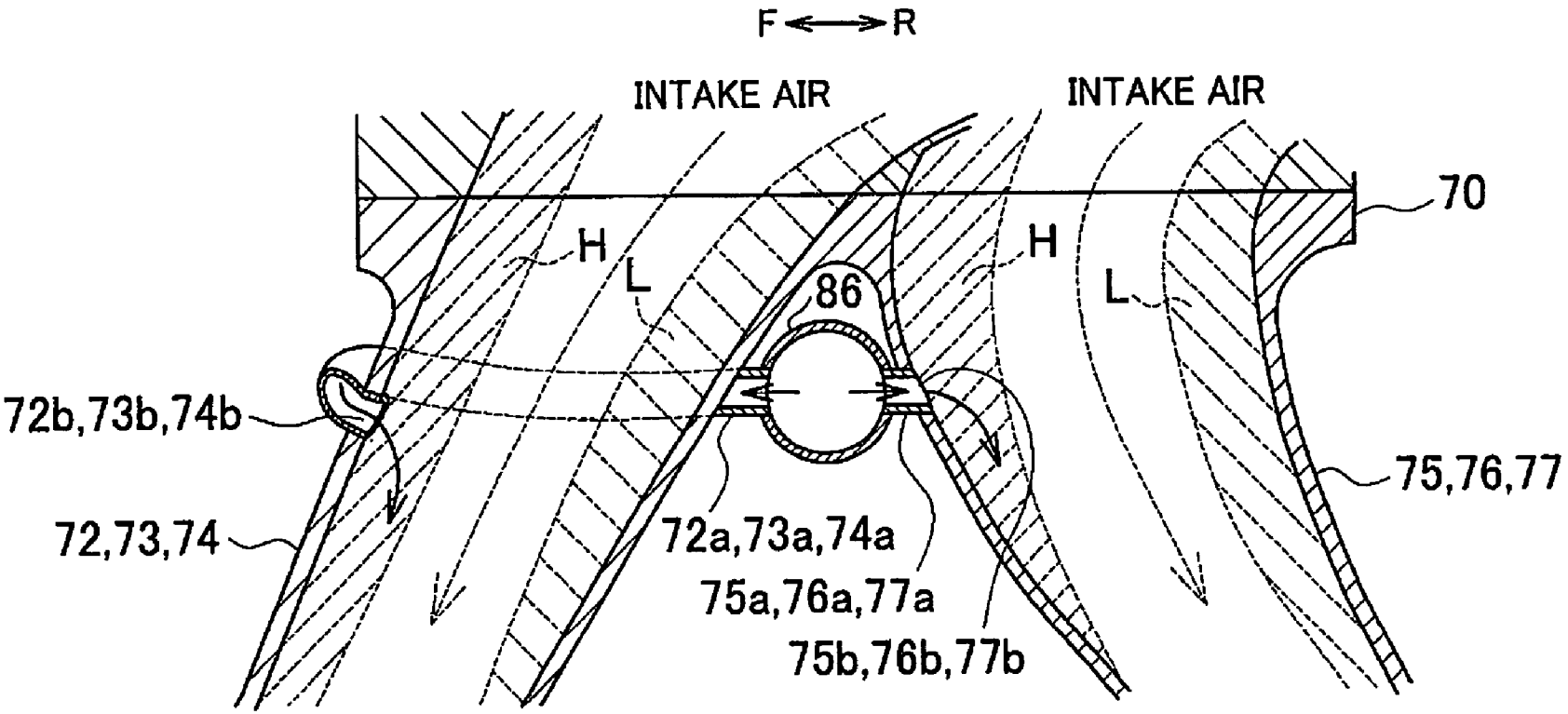
FIG. 4 is an enlarged view showing a main portion of the mechanism in FIG. 3.

Hereafter, a second embodiment of the invention will be described. FIGS. 3 and 4 show the structure according to the second embodiment of the invention. The second embodiment differs from the first embodiment as follows. According to the second embodiment of the invention, exhaust gas inlets 72*b*, 73*b*, and 74*b* of gas introduction passages 72*a*, 73*a*, and 74*a* for a right bank 52, which extend from an EGR pipe 86, and exhaust gas inlets 75*b*, 76*b* and 77*b* of gas introduction passages 75*a*, 76*a* and 77*a* for a left bank 54, which extend from the EGR pipe 86, are both formed in wall faces of branch pipes 72 to 77 at portions on the side opposite to the side on which a branch portion of the surge tank 68 is located. That is, the portions of the wall faces of the branch pipes 72 to 74, at which the exhaust gas inlets 72*b* to 74*b* are formed, respectively, and the portions of the wall faces of the branch pipes 75 to 77, at which the exhaust gas inlets 75*b* to 77*b* are formed, respectively, are on the same side in the same direction among the directions perpendicular to the direction in which the intake passages 62 to 64 are aligned and the intake passages 65 to 67 are aligned (direction perpendicular to the sheets on which FIGS. 3 and 4 are drawn). In other words, the exhaust gas inlets 72*b* to 77*b* are formed in the wall faces of the branch pipes 72 to 77 at the portions, which correspond to outer curve portions of curved portions of intake passages 62 to 67 that extend from the branch portion of the surge tank 68, respectively.

The other structures in the second embodiment of the invention are the same as those in the first embodiment of the invention. Therefore, the exhaust gas is introduced from the gas introduction passages 72*a* to 77*a* into the branch pipes 72 to 77 through the high-pressure regions H, that is, the outer curve portions of the curved portions of the branch pipes 72 to 77, respectively.

According to the second embodiment of the invention described above, the following effect is obtained. 1) The inlets 72*b* to 74*b* through which the exhaust gas is introduced from the EGR pipe 86 into the intake passages 62 to 64 for cylinders 56 to 58 in the right bank 52, respectively, are within the high-pressure regions H. Similarly, the inlets 75*b* to 77*b* through which the exhaust gas is introduced from the EGR pipe 86 into the intake passages 65 to 67 for cylinders 59 to 61 in the left bank 54, respectively, are within the high-pressure regions H. That is, the exhaust gas inlets 72*b* to 77*b* are formed at positions where the pressure of the intake air flowing through the branch pipes 72 to 74 for the cylinders 56 to 58 in the right bank 52 and the pressure of the intake air flowing through the branch pipes 75 to 77 for the cylinders 59 to 61 in the left bank 54 are substantially equal to each other. Accordingly, the amount of exhaust gas that is introduced into each of the cylinders 56 to 58 in the right bank 52 and the amount of exhaust gas that is introduced into each of the cylinders 59 to 61 in the left bank 54 are substantially equal to each other. These inlets 72*b* to 77*b* are not formed at positions in the common intake passage from which the branch paths branch off, that is, these inlets 72*b* to 77*b* are not formed at positions upstream of a surge tank 68. Accordingly, the response to introduction of the exhaust gas is not deteriorated but is maintained.

Hereafter, a third embodiment of the invention will be described. The single EGR pipe 36 is shared by all the intake passages 12 to 17 in the first embodiment of the invention, and the single EGR pipe 86 is shared by all the intake passages 62 to 67 in the second embodiment of the invention. In contrast, according to the third embodiment of the invention, two EGR pipes are provided for intake passages as shown in FIGS. 5A and 5B.

Figure 5A:
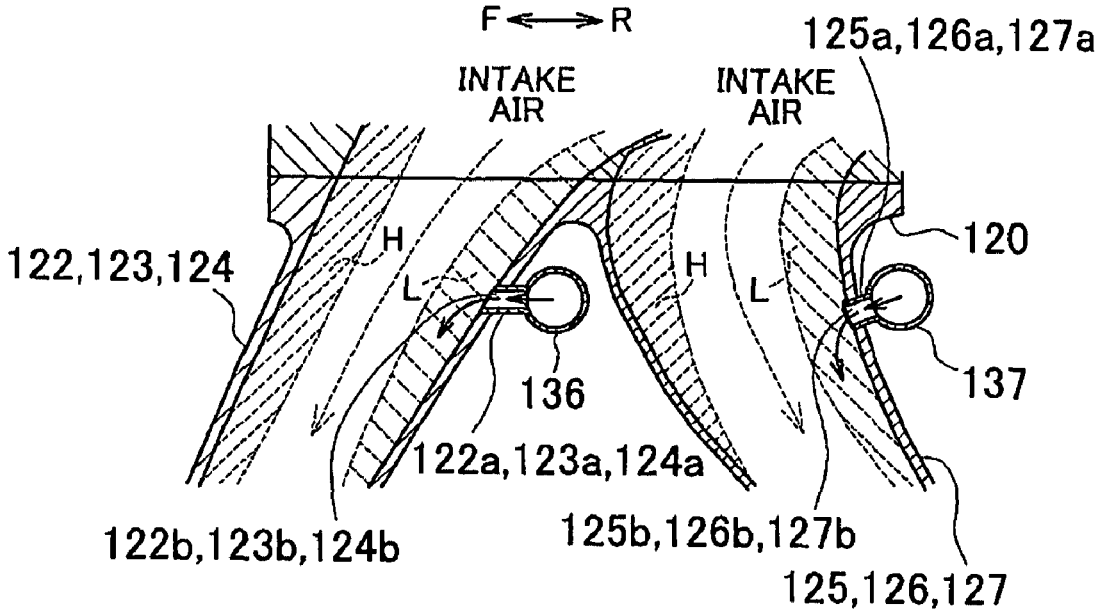
FIG. 5A and FIG. 5B each illustrate a longitudinal cross-sectional view schematically showing the structure of a main portion of a mechanism that introduces gas into intake air according to a third embodiment of the invention.
Figure 5B:
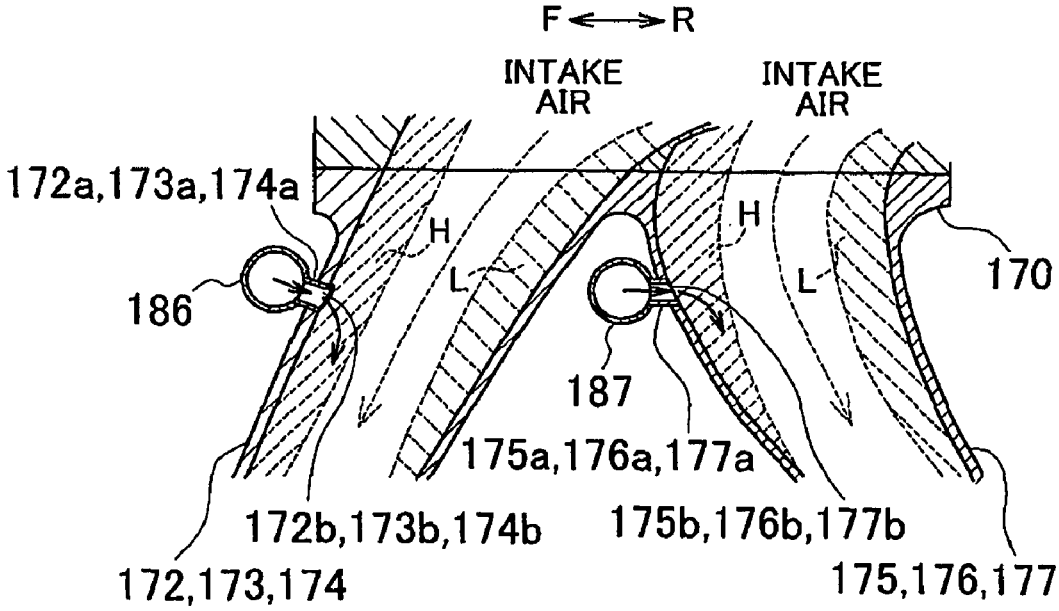

In an example shown in FIG. 5A, an EGR passage 136 extends along the direction in which branch pipes 122, 123 and 124 on the right bank side are aligned, and is arranged at a position behind the branch pipes 122, 123 and 124. In addition, another EGR pipe 137 extends along the direction in which branch pipes 125, 126 and 127 are aligned, and is arranged at a position behind the branch pipes 125, 126 and 127.

Exhaust gas inlets 122*b*, 123*b* and 124*b* of gas introduction passages 122*a*, 123*a* and 124*a*, through which the exhaust gas is introduced from the EGR pipe 136, are formed in wall faces of the branch pipes 122, 123 and 124 at portions closest to the EGR pipe 136, respectively. Similarly, exhaust gas inlets 125*b*, 126*b* and 127*b* of gas introduction passages 125*a*, 126*a* and 127*a*, through which the exhaust gas is introduced from the EGR pipe 137, are formed in wall faces of the branch pipes 125, 126 and 127 at portions closest to the EGR pipe 137, respectively. Thus, the inlets 122*b* to 127*b* open at the low-pressure regions L, and the exhaust gas in the EGR pipes 136 and 137 is introduced into the intake air flowing through the branch pipes 122 to 127. Because the EGR pipe 136 is provided for one of the banks and the EGR pipe 137 is provided for the other bank, it is possible to introduce the exhaust gas into the intake air at the low-pressure regions L.

The exhaust gas inlets 122*b* to 127*b* are formed in the wall faces of the branch pipes 122 to 127 at portions on the side on which the branch portion of the surge tank is located. That is, the portions of the wall faces of the branch pipes 122 to 124, at which the exhaust gas inlets 122*b* to 124*b* are formed, respectively, and the portions of the wall faces of the branch pipes 125 to 127, at which the exhaust gas inlets 125*b* to 127*b* are formed, respectively, are on the same side in the same direction among the directions perpendicular to the direction in which the intake passages 122 to 124 are aligned and the intake passages 125 to 127 are aligned (direction perpendicular to the sheet on which FIG. 5A is drawn). In other words, the exhaust gas inlets 122*a* to 127*b* are formed in the wall faces of branch pipes 122 to 127 at the portions, which correspond to inner curve portions of curved portions of intake passages that extend from the branch portion of the surge tank.

With the structure shown in FIG. 5A, the effects that are the same as those in the first embodiment of the invention are obtained. In an example shown in FIG. 5B, an EGR pipe 186 extends along the direction in which branch pipes 172, 173 and 174 of an intake manifold 170 on the right bank side are aligned, and is arranged at a position in front of the branch pipes 172, 173 and 174. In addition, another EGR pipe 187 extends along the direction in which branch pipes 175, 176 and 177 are aligned, and is arranged at a position in front of the branch pipes 175, 176 and 177.

Exhaust gas inlets 172*b* to 174*b* of gas introduction passages 172*a* to 174*a*, through which the exhaust gas is introduced from the EGR pipe 186, are formed in wall faces of the branch pipes 172 to 174 at portions closest to the EGR pipe 186, respectively. Similarly, exhaust gas inlets 175*b* to 177*b* of gas introduction passages 175*a* to 177*a*, through which the exhaust gas is introduced from the EGR pipe 187, are formed in wall faces of the branch pipes 175 to 177 at portions closest to the EGR pipe 187, respectively. Thus, the inlets 172*b* to 177*b* open at the high-pressure regions H, and the exhaust gas in the EGR pipes 186 and 187 is introduced into the intake air flowing through the branch pipes 172 to 177. Because the EGR pipe 186 is provided for one of the banks and the EGR pipe 187 is provided for the other bank, it is possible to introduce the exhaust gas into the intake air at the high-pressure regions H.

The exhaust gas inlets 172*b* to 177*b* are formed in the wall faces of the branch pipes 172 to 177 at portions on the side opposite to the side on which the branch portion of the surge tank is located. That is, the portions of the wall faces of the branch pipes 172 to 174, at which the exhaust gas inlets 172*b* to 174*b* are formed, respectively, and the portions of the wall faces of the branch pipes 175 to 177, at which the exhaust gas inlets 175*b* to 177*b* are formed, respectively, are on the same side in the same direction among the directions perpendicular to the direction in which the intake passages 172 to 174 are aligned and the intake passages 175 to 177 are aligned (direction perpendicular to the sheet on which FIG. 5B is drawn). In other words, the exhaust gas inlets 172*b* to 177*b* are formed in the wall faces of the branch pipes 172 to 177 at the portions, which correspond to outer curve portions of curved portions of intake passages that extend from the branch portion of the surge tank.

With the structure shown in FIG. 5B, the effect that is the same as that in the second embodiment of the invention is obtained. In each of the embodiments described above, the invention is applied to EGR, and the gas that is introduced into the intake passage is exhaust gas. Alternatively, the invention may be applied to the case in which gas other than exhaust gas, for example, blow-by gas or purge fuel gas from a canister is supplied to the intake passage.

In each of the embodiments of the invention described above, the cross section of the EGR pipe is circular. Alternatively, the cross section of the EGR pipe may be triangular or trapezoidal so that the space between the banks is utilized more efficiently.

What is claimed is:

1. A structure for introducing gas into intake air in an internal combustion engine which includes a plurality of banks and in which the intake air is distributed to cylinders through individual intake passages that branch off from a common intake passage, comprising:

gas inlets that are formed in wall faces of the individual intake passages at positions where pressures of the intake airs flowing through the individual intake passages that lead to the cylinders in the plurality of banks are substantially equal to each other, wherein the number of the banks of the internal combustion engine is two, wherein a branch portion at which the individual intake passages branch off from the common intake passage is located on a side of one of the two banks, and wherein the gas inlets are formed in the wall faces at portions on a same side in a same direction among directions perpendicular to a direction in which the individual intake passages for each bank are aligned.

2. A structure for introducing gas into intake air in an internal combustion engine which includes a plurality of banks and in which the intake air is distributed to cylinders through individual intake passages that branch off from a common intake passage, comprising:

gas inlets that are formed in wall faces of the individual intake passages, wherein the number of the banks of the internal combustion engine is two, wherein a branch portion at which the individual intake passages branch off from the common intake passage is located on a side of one of the two banks, and wherein the gas inlets are formed in the wall faces at portions on a same side in a same direction among directions perpendicular to a direction in which the individual intake passages for each bank are aligned.

3. The structure according to claim 2, wherein the side on which the gas inlets are formed is the side on which the branch portion is located.

4. The structure according to claim 2, wherein the side on which the gas inlets are formed is a side opposite to the side on which the branch portion is located.

5. The structure according to claim 2, wherein the portions of the wall faces of the individual intake passages at which the gas inlets are formed correspond to inner curve portions of curved portions of the individual intake passages that extend from the branch portion.

6. The structure according to claim 2, wherein the portions of the wall faces of the individual intake passages at which the gas inlets are formed correspond to outer curve portions of curved portions of the individual intake passages that extend from the branch portion.

7. The structure according to claim 1, wherein the gas is exhaust gas.

8. The structure according to claim 1, wherein the gas is blowby gas or purge fuel gas from a canister.

9. The structure according to claim 1, further comprising:

gas introduction passages; and an EGR gas pipe, wherein the gas in the EGR gas pipe is introduced into the gas introduction passages, and then introduced into the individual intake passages through the gas inlets.

10. The structure according to claim 9, wherein the individual intake passages for each bank are provided with the EGR pipe that is exclusive to the bank.

11. The structure according to claim 2, wherein:

the common intake passage includes a surge tank that is formed at the branch portion; and the individual intake passages branch off from the surge tank.

12. The structure according to claim 11, wherein the side on which the gas inlets are formed is the side on which the branch portion is located.

13. The structure according to claim 11, wherein the side on which the gas inlets are formed is a side opposite to the side on which the branch portion is located.

14. The structure according to claim 11, wherein the portions of the wall faces of the individual intake passages at which the gas inlets are formed correspond to inner curve portions of curved portions of the individual intake passages that extend from the branch portion.

15. The structure according to claim 11, wherein the portions of the wall faces of the individual intake passages at which the gas inlets are formed correspond to outer curve portions of curved portions of the individual intake passages that extend from the branch portion.

* * * * *